US005674139A

United States Patent [19]

Brooks

[11] Patent Number: 5,674,139

[45] Date of Patent: Oct. 7, 1997

[54] VOLLEYBALL GAME

[76] Inventor: John D. Brooks, 9143-C Paul Revere Dr., St. Louis, Mo. 63123

[21] Appl. No.: 700,218

[22] Filed: Aug. 20, 1996

[51] Int. Cl.[6] ..... A63B 67/00

[52] U.S. Cl. ..... 473/473

[58] Field of Search ..... 273/411, 29 R, 273/29 B, 29 BB, 30, 31; 473/473

[56] References Cited

U.S. PATENT DOCUMENTS

| | | | |
|---|---|---|---|
| 1,983,373 | 12/1934 | Horton | 273/31 |
| 3,105,682 | 10/1963 | Ahrens | 273/29 R X |
| 3,452,985 | 7/1969 | D'Zmura | 273/30 |
| 3,948,521 | 4/1976 | Warren | 273/411 X |
| 4,014,521 | 3/1977 | Berman | 273/29 B X |
| 4,108,434 | 8/1978 | Royer | 273/30 |
| 4,253,673 | 3/1981 | Bailey | 273/411 X |
| 4,336,942 | 6/1982 | Warehime | 273/411 |
| 4,387,898 | 6/1983 | Mangum | 273/411 |
| 4,492,380 | 1/1985 | Saytar | 273/411 |
| 4,720,112 | 1/1988 | Stettner | 273/411 |
| 4,786,053 | 11/1988 | Barnes, Jr. | 273/411 X |
| 4,826,178 | 5/1989 | Cloran | 273/411 |
| 5,112,061 | 5/1992 | Lamle | 273/411 |
| 5,217,230 | 6/1993 | Judd | 273/401 |
| 5,303,932 | 4/1994 | Kessler | 273/411 |
| 5,385,350 | 1/1995 | Norman | 273/29 B |

*Primary Examiner*—William H. Grieb
*Attorney, Agent, or Firm*—Chase & Yakimo

[57] ABSTRACT

A game playing apparatus includes a center pole having at least first, second and third nets radially extending therefrom and attached at their ends to end poles. A boundary line extends between the end poles so as to define a circular playing surface divided into three equal area sectors, each sector defining a court for a team. The game is preferably volleyball by which one team competes against the other two teams via conventional volleyball rules. Each team may hit the volleyball over either one of the two nets defining its sector in a manner to preclude return by the other team. The extensible center pole and end poles include collars slidable therealong allowing for adjustment of the net heights. A guide on the center pole indicates a path of initial extension of each net away from the center pole preferably at 120°.

9 Claims, 3 Drawing Sheets

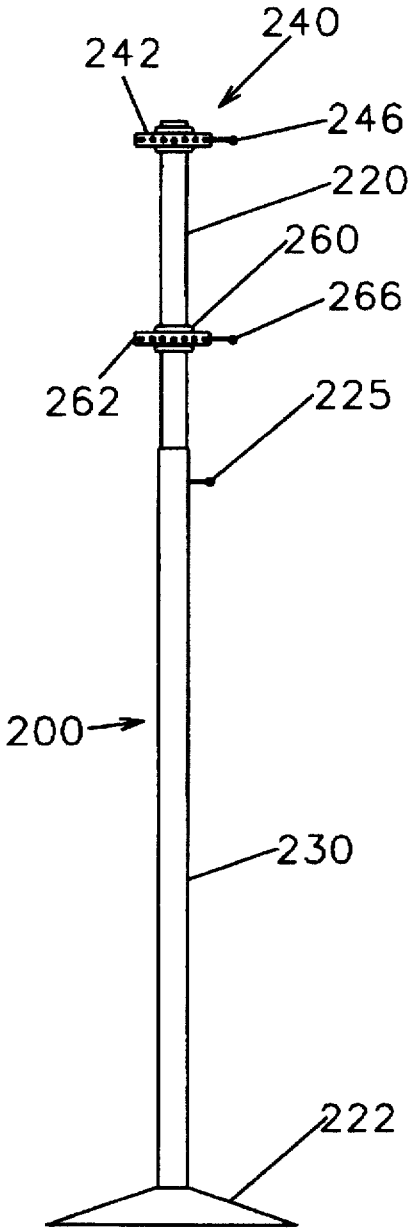
FIG. 3
FIG. 5
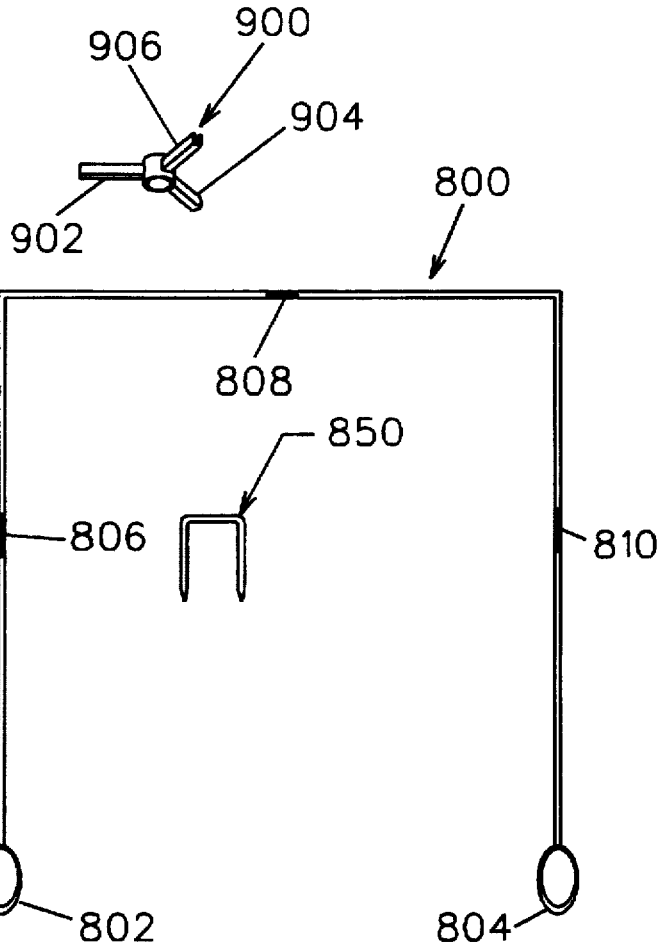
FIG. 4

VOLLEYBALL GAME

BACKGROUND OF THE INVENTION

This invention relates to a volleyball game and, more particularly, to a novel volleyball game court, accompanying apparatus and method allowing for simultaneous, competitive play by three teams.

The popularity of volleyball is a burgeoning one. In traditional volleyball two teams, separated by a net, compete one against the other within the confines of a rectangular court. During recreational play the number of available volleyball participants may require that more than the traditional six players on a team be utilized. Also, in such instances, some of the additional players may need to rotate to the sidelines, i.e. at a waiting position removed from game play. Accordingly, it is desirable to provide a game of volleyball in which more than two teams can simultaneously play so as to not only present a novel game but also accommodate the additional players.

In response thereto I have invented a novel volleyball game and enabling apparatus therefor which allows three teams of at least six players to compete against each other according to generally conventional volleyball game rules. The game is preferably played on a circular court, the court divided into three equal sectors, one for each team, as defined by three nets radially extending between a center pole at the court's center and three end poles equally spaced about the circumference of the playing surface. Ground adjacent lines or ropes extend between adjacent end poles so as to define an arc-shaped end line of each playing sector. The center pole includes structure for adjusting the height of the nets as well as adjusting the angle therebetween. Upon net placement, three teams simultaneously compete one against the other utilizing conventional volleyball game rules.

It is therefore a general object of this invention to provide a novel volleyball game.

Another object of this invention is to provide a novel volleyball game and accompanying apparatus therefor.

A further general object of this invention is to provide a volleyball game, as aforesaid, enabling three teams to simultaneously play a game of volleyball with one team competing against the other two teams.

A further object of this invention is to provide apparatus for playing the volleyball game, such apparatus including a center pole, at least three end poles radially displaced from the center pole and a net extending between the center pole and each end pole.

A further object of this invention is to provide a volleyball game with apparatus, as aforesaid, including a boundary rope extending between adjacent end poles to further define an end line of each playing court for each team.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 3 is an elevation view showing a center lead pole;

FIG. 4 is a plan view showing the boundary rope for extension between adjacent end poles and ground fastener; and FIG. 5 is a perspective view showing a divider for use on the center pole.

DESCRIPTION OF THE PREFERRED EMBODIMENT

Figure 1:
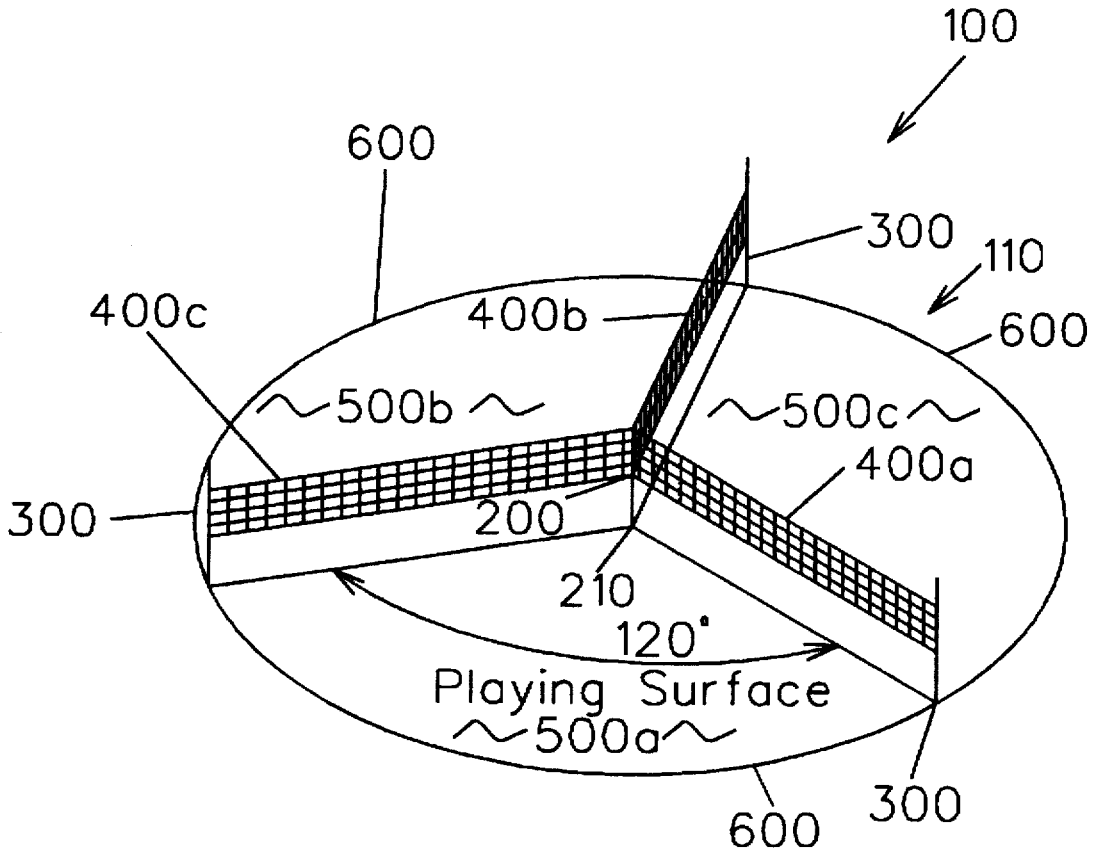
FIG. 1 is a perspective view diagrammatically showing the playing surface and apparatus for the novel volleyball game.

Turning more particularly to the drawings, FIG. 1 shows the game court as comprising a circular playing surface 100 having a center pole 200 at the center point 210 thereof. Radially extending between the center pole 200 and end poles 300 spaced about the circumference 110 of the court 100 are nets 400*a*, 400*b*, 400*c*. The nets are conventional volleyball nets and may be positioned at various conventional heights according to the desires and/or types of the game players.

As shown, each net 400*a*, 400*b*, 400*c* radially extends between the center pole 200 and respective end poles 300 at 120° intervals. As such, three sectors 500*a*, 500*b*, 500*c* are defined within the circular surface 100, the straight line sides of each sector being defined by two of the respective nets.

Figure 2:
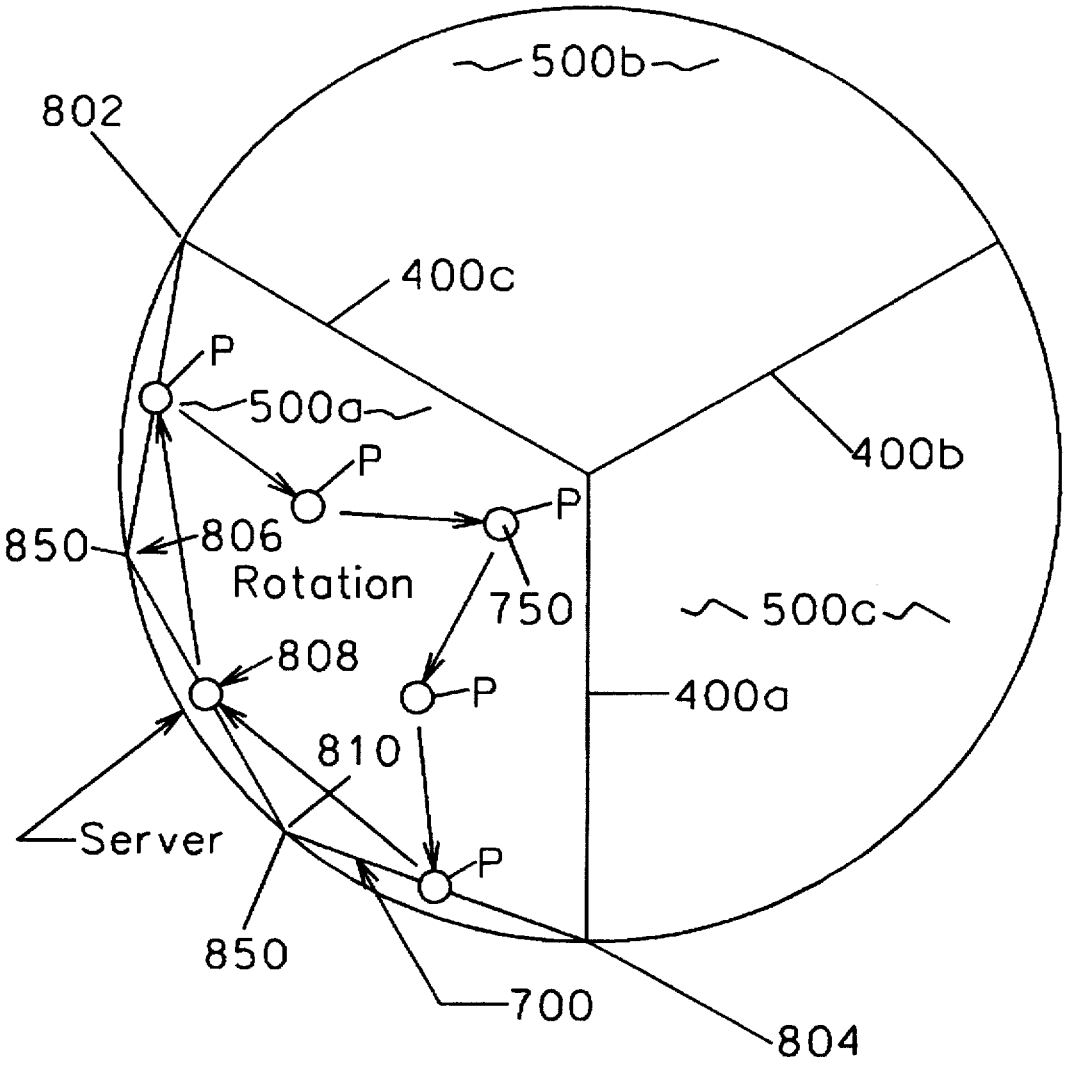
FIG. 2 is a top diagrammatic view showing the three playing courts and the manner of rotation of the six players of one team within one of the playing courts.

The arc-shaped end line of the respective sector 500*a*, 500*b*, 500*c* may be defined by ground markings or a rope 800 having loops 802, 804 at the ends thereof, the loops 802, 804 being attached between the end poles 300 in an arc therebetween. Alternatively, each rope 800 may have indicia 806, 808, 810 thereon at selected intervals which indicate where fasteners 850 are to be located so as to hold the ropes in the ground at such points. As such, an alternative angled end line boundary 700, as shown in FIG. 2, may be presented having discrete angled sections as opposed to the arc-shaped end line 600 for each sector 500*a*, 500*b*, 500*c*.

The center pole 200, as shown in FIG. 3, comprises first and second elongated telescopic rod sections 220, 230 extending from a weighted pedestal 222. Accordingly, section 220 may be relatively vertically displaced from section 230 and held thereat by an I-bolt 225 which extends through section 230 and bears against rod section 220. Thus, the overall height of the center pole 200 is adjustable.

Located on the center pole section 220 are two hubs 240, 260 which include disc-like collars 242, 262 slidable along pole 220 in a friction fit relationship therebetween. These collars 242, 262 further have a plurality of apertures around the circumference thereof. The string ties at the end of each net are tied to bolts 246, 266 which fit within the apertures. As shown in FIG. 5, a divider 900 may be further attached at the tope of center pole 200, the divider 900 having flanges 902, 904, 906 spaced at 120° intervals. These flanges define the initial radial extension of each net from the center pole 200 and thus where to fasten the bolts 246, 266 about each hub collar 242, 262.

The end poles 300 are similar in construction to the center pole 200 so as to receive the opposed ends of each net 400*a*, 400*b*, 400*c*.

As best shown in FIG. 2, the game may be played by six players, the positions of one team in sector 500*a* being shown. As shown, the server stands outside the defined boundary line, 600 or 700 for that team's sector, i.e. a zone preferably at the end point of a radius extending from the center pole 200, the radius bisecting that team's sector. Rotation of the players after a team wins a side out is in a clockwise direction as diagrammatically indicated.

Although a conventional volleyball and conventional volleyball game rules are preferably used, one rule that may be utilized is that the players, as initially positioned adjacent one of the nets defining a sector, such as nets 400*a*, 400*c*, can hit the ball only over that initially adjacent net. The central front line player 750 and server 800 will have the option to hit the ball over either net. This rule assures distribution of game play about the circular court and among the three teams. As such, it can be seen that during game play each team has the option of hitting the volleyball over one of two nets depending on the player handling the volleyball in a manner to preclude return of the ball by either one of the opposing teams. Thus, the ball can be hit in either clockwise or counterclockwise directions about the playing surface 100 by any team. Accordingly, all three teams can anticipate the volleyball being hit in their direction.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A game apparatus for simultaneous play of a game by three teams comprising:

a center pole;

a first collar about said center pole;

a plurality of apertures about said first collar;

a first plurality of three bolts, each bolt releasably insertable in a selected one aperture of said plurality of first collar apertures, each of said inserted bolts presenting a free end;

a second collar about said center pole and vertically displaced from said first collar;

a plurality of apertures about said second collar;

a second plurality of three bolts, each bolt of said second plurality of three bolts releasably insertable in a selected aperture of said plurality of apertures in said second collar, each of said inserted bolts presenting a free end;

a divider element for fastening about said center pole, said divider having a plurality of three radially spaced-apart flanges, each flange extending at an angle from said center pole for defining a placement of one of said three bolts of said first and second plurality of bolts in said respective first and second collar apertures about said center pole;

first, second and third nets, each net having a first end portion attached to a respective free end of one of said three bolts in said first and second collars, each net extending from said center pole at an angle corresponding to said angle of extension of one of said three flanges of said divider;

first, second and third end poles at an end of each extended net for attachment of an opposed second end of each respective net thereto;

means for defining a ground adjacent boundary between adjacent end poles, said boundary means cooperating with said nets to define first, second and third sectors of a playing surface, each of said sectors for game play of a team thereon, each team competing against an adjacent team in adjacent sectors, the game play involving a hitting of an object over a net by a team in one sector to a team in another sector.

2. The apparatus as claimed in claim 1 wherein said defining means comprises a rope having first and second opposed ends, each end attached to an end pole, an extension of the rope along the ground presenting said boundary for said sector defined between said end poles.

3. The apparatus as claimed in claim 2 further comprising:

indicia on said rope at a selected distance from a rope end;

means for engaging said rope to the ground at said indicia, said engaging means presenting a plurality of discrete rope portions defining said boundary.

4. The apparatus as claimed in claim 2 wherein said rope defines an arc between said end poles.

5. The apparatus as claimed in claim 1 wherein said collars are slidable along said center pole whereby to vary a height of said bolts in said nets attached to said collars.

6. The apparatus as claimed in claim 1 wherein said center pole comprises:

a first upper rod having a top end elevated above the ground, said nets attached to said upper rod;

a second lower rod having a lower end adjacent the ground and configured to slidably receive said first upper rod therein, a slidable movement of said first rod varying the displacement of said top end of said first rod from said second rod;

means for maintaining a selected displacement of said first rod from said second rod whereby to vary a height of said nets attached thereto.

7. The apparatus as claimed in claim 1 wherein an angle of extension between adjacent nets of said nets is approximately 120°.

8. The apparatus as claimed in claim 1 wherein said sectors are equal in area.

9. The apparatus as claimed in claim 1 wherein the object is a volleyball.

* * * * *